US009518444B2

(12) United States Patent
Thompson

(10) Patent No.: US 9,518,444 B2
(45) Date of Patent: Dec. 13, 2016

(54) VALVE ASSEMBLY

(75) Inventor: Richard William Thompson, Edinburgh (GB)

(73) Assignee: Expro North Sea Limited, Aberdeen (GB)

( * ) Notice: Subject to any disclaimer, the term of this patent is extended or adjusted under 35 U.S.C. 154(b) by 664 days.

(21) Appl. No.: 13/884,748

(22) PCT Filed: Nov. 15, 2011

(86) PCT No.: PCT/GB2011/001605

§ 371 (c)(1),
(2), (4) Date: Jul. 10, 2013

(87) PCT Pub. No.: WO2012/066282

PCT Pub. Date: May 24, 2012

(65) Prior Publication Data

US 2013/0292133 A1 Nov. 7, 2013

(30) Foreign Application Priority Data

Nov. 18, 2010 (GB) ..... 1019499.1

(51) Int. Cl.
*E21B 34/06* (2006.01)
*E21B 34/10* (2006.01)
(Continued)

(52) U.S. Cl.
CPC ..... *E21B 34/06* (2013.01); *E21B 34/063* (2013.01); *E21B 34/10* (2013.01); *E21B 34/14* (2013.01);
(Continued)

(58) Field of Classification Search
None
See application file for complete search history.

(56) References Cited

U.S. PATENT DOCUMENTS 4,100,969 A 7/1978 Randermann, Jr.
4,415,036 A 11/1983 Carmody et al.
(Continued)

FOREIGN PATENT DOCUMENTS

EP 0376930 7/1990
EP 0753646 1/1997
(Continued)

*Primary Examiner* — Jennifer H Gay
*Assistant Examiner* — Caroline Butcher

(57) ABSTRACT

A valve assembly (2) which is configured to be coupled to a tubing string comprises a housing (8) defining a housing flow path (9) for communicating with the tubing string, and a barrier member (14) located in the housing (8) and configurable between a normally-closed position in which the barrier member (14) restricts access through the housing flow path (9), and an open position in which access is permitted through the housing flow path (9). The valve assembly (2) also comprises a bypass arrangement reconfigurable between an open state in which the bypass arrangement defines a bypass flow path that communicates with the housing flow path (9) on opposite sides of the barrier member (14) to permit fluid to bypass the barrier member and thereby fill the tubing string, and a closed state in which fluid is prevented from bypassing the barrier member to thereby permit pressurization of the tubing string.

35 Claims, 3 Drawing Sheets

(51) Int. Cl.
*E21B 34/14* (2006.01)
*E21B 34/00* (2006.01)

(52) U.S. Cl.
CPC .... *E21B 2034/005* (2013.01); *E21B 2034/007* (2013.01)

(56) References Cited

U.S. PATENT DOCUMENTS

| | | | | |
|---|---|---|---|---|
| 4,694,903 | A | 9/1987 | Ringgenberg | |
| 5,649,597 | A * | 7/1997 | Ringgenberg | E21B 34/101 166/320 |
| 6,189,618 | B1 * | 2/2001 | Beeman | E21B 34/14 166/194 |
| 2004/0026091 | A1 * | 2/2004 | Patel | E21B 21/10 166/386 |
| 2006/0011354 | A1 | 1/2006 | Logiudice et al. | |

FOREIGN PATENT DOCUMENTS

| | | |
|---|---|---|
| GB | 2388619 | 11/2003 |
| WO | 2006034214 | 3/2006 |

* cited by examiner

VALVE ASSEMBLY

FIELD OF THE INVENTION

The present invention relates to a valve assembly for use with a tubing string. In particular, the present invention relates to a valve assembly for permitting filling of a tubing string with wellbore fluids while being deployed into a wellbore, and facilitating testing of the tubing string during deployment.

BACKGROUND TO THE INVENTION

In the oil and gas production industry wellbores are drilled into the earth to intercept subterranean hydrocarbon bearing formations and then lined with metal tubulars and cement to provide sealing and support. Once a bore has reached its required depth and is suitably lined, production or completion architecture is deployed into the bore to facilitate controlled production of hydrocarbons. Typical completion architecture includes tubing strings, for example production tubing strings which provide a continuous flow path between the subterranean formation and the surface. Production tubing strings may also carry appropriate tools and other completion equipment, such as valves, packers, sensor suites and the like.

Tubing strings are generally formed and deployed in sections, with individual sections secured to each other by threaded connectors and deployed in a staged manner. To enable deployment it is required to permit the tubing string to fill with the wellbore fluid, typically called a completion fluid. It is also desirable to be able to test the pressure integrity of the tubing string, particularly the integrity of the threaded connectors, during the process of deployment.

Arrangements are known in the art which provide an open orifice in the lower end of a tubing string which permits filling during deployment. Whenever pressure testing is required a plug may be run from surface, for example on coiled tubing, to block the orifice and permit the internal tubing pressure to be increased for testing purposes. Following this the plug may be retrieved to surface. However, such an arrangement requires repeated deployment and retrieval of additional equipment to/from the wellbore, increasing deployment time and the risk of equipment becoming stuck in the bore.

Other arrangements are known, for example from U.S. Pat. No. 7,063,156, which are based on the use of a flapper valve mounted at the lower end of a tubing string. During deployment the relative motion of the tubing string and wellbore fluid causes the flapper valve to open, usually against the bias of a spring, to permit filling of the string. When pressure testing is required deployment of the string is temporarily arrested permitting the flapper to close, for example under the action of a bias spring, allowing the valve to support pressure from above to facilitate pressure testing. Once the tubing string is fully deployed, the flapper valve may be actuated, for example by an internal sleeve, to be permanently held open, thus providing a permanent flow path through the string. In such prior art arrangements, pressure for testing the string is retained by the flapper valve which also functions to permit filling of the string. Accordingly, the flapper valve and associated sealing structures are at risk of damage and clogging by debris carried within the wellbore fluid entering the string, which can adversely affect the sealing integrity of the flapper valve, reducing its ability to support desired pressure testing.

SUMMARY OF THE INVENTION

According to a first aspect of the present invention there is provided a valve assembly configured to be coupled to a tubing string, comprising:

a housing defining a housing flow path for communicating with the tubing string;

a barrier member located in the housing and configurable between a normally-closed position in which the barrier member restricts access through the housing flow path, and an open position in which access is permitted through the housing flow path; and a bypass arrangement reconfigurable between an open state in which the bypass arrangement defines a bypass flow path that communicates with the housing flow path on opposite sides of the barrier member to permit fluid to bypass the barrier member and thereby fill the tubing string, and a closed state in which fluid is prevented from bypassing the barrier member to thereby permit pressurization of the tubing string.

The bypass arrangement may be configured between a normally-open state and the closed state.

The valve assembly may be secured to a tubing string, such as a leading end of a tubing string, wherein the valve assembly facilitates desired filling and pressurization of the tubing string during deployment into a wellbore. That is, the valve assembly may be configured to permit the flow of a wellbore fluid into an associated tubing string during deployment into a wellbore. The requirement to permit such filling of a tubing string is well known in the art. The valve assembly may be reconfigured to permit the fluid pressure within the tubing string to be increased, for example above the wellbore pressure. Such pressurization may be used for a number of purposes. For example, pressurization may be desirable to test the integrity of the tubing string, such as the integrity of connectors within the string. Pressurization may be desirable to operate or actuate one or more downhole tools, such as a tool incorporated within the tubing string.

In use, the valve assembly may be configured such that the barrier member is in the normally-closed position and the bypass arrangement is in the open state to permit fluid to flow from one side of the barrier member to the other via the bypass flow path to permit filling of an associated tubing string. The barrier member remains in the normally-closed position during filling of a tubing string, such that any adverse effect on the sealing integrity of the barrier member is minimised.

When pressurization of an associated tubing string is required, the barrier member remains in the normally-closed position and the bypass arrangement is reconfigured to the closed state, such that both the closed barrier member and the bypass arrangement support increasing pressure within the string.

The barrier member may be configured to an open position once desired filling and pressurization cycles have been achieved, for example when the tubing string reaches its total depth. Configuring the barrier member to its open position may permit access through the housing flow path, for example to accommodate through tubing wellbore operations such as production, injection, surface deployed intervention and the like. The barrier member may be configured to permit substantially full bore access through the housing flow path when in the open position.

The housing flow path may be located radially inwardly of the bypass flow path.

The housing flow path may be located within the bypass flow path.

The housing flow path may be located substantially centrally within the housing, for example the housing flow path may be generally aligned along an axis of the housing.

The housing flow path may be aligned parallel to but offset from an axis of the housing.

At least a portion of the bypass flow path may be defined within the housing. At least a portion of the bypass flow path may be defined by an inner surface of a wall of the housing. At least a portion of the bypass flow path may be defined within a wall of the housing. At least a portion of the bypass flow path may be defined externally of the housing.

The bypass arrangement may define an annular bypass flow path. Such an annular bypass flow path may circumferentially surround at least a portion of the housing flow path.

The bypass arrangement may comprise one or more bypass ports on opposite sides of the barrier member configured to facilitate communication between the bypass flow path and the housing flow path. At least one bypass port may be configured to impart a desired flow regime within the bypass flow path. The desired flow regime may be selected to assist passage of particulate matter carried by a fluid, for example to minimise the risk of clogging of the bypass flow path. In at least one embodiment, at least one bypass port may be configured to establish rotational flow within the bypass flow path. At least one bypass port may be configured to establish turbulent flow within the bypass flow path.

The bypass arrangement may be configured to permit flow through the bypass flow path in opposite directions. This arrangement may permit the valve assembly to facilitate filling of an associated tubing string, for example during deployment into a wellbore, and emptying of the tubing string, for example during retrieval from a wellbore.

The bypass arrangement may be configured to permit flow through the bypass flow path in a single direction. For example, the bypass arrangement may be configured to permit flow in one direction, for example to facilitate filling of an associated tubing string, and to prevent flow in an opposite direction, for example to permit pressurization within the tubing string for integrity testing thereof.

The bypass arrangement may be reconfigurable to an open state in response to flow in one direction, for example to fill an associated tubing string, and be reconfigurable into a closed state in response to flow in an opposite direction, for example to permit pressurization within the tubing string for integrity testing thereof.

The bypass arrangement may be biased towards an open state. For example, the bypass arrangement may have an associated normally-open state to permit filling or emptying of an associated tubing string. The bypass arrangement may be reconfigurable to the closed state against this bias, for example the bypass arrangement may be reconfigured to the closed state against this bias by increasing pressure of a fluid within an associated tubing string.

The bypass arrangement may be configured for actuation by any suitable means, for example, the bypass arrangement may be configured for actuation using an electric actuator such as a motor, solenoid or the like.

The bypass arrangement may be configured for actuation using a hydraulic actuator such as a piston arrangement or the like.

The bypass arrangement may be configured for actuation using variable flow restriction. For example, the bypass arrangement may provide a different restriction to a flow of fluid and thereby cause a different actuation force to be generated according to the fluid flow. The different actuation forces generated may be used to actuate the bypass arrangement.

The bypass arrangement may provide a different restriction to a flow of fluid according to the direction of fluid flow.

The bypass arrangement may provide a different restriction to a flow of fluid according to the magnitude of fluid flow.

The bypass arrangement may provide a different restriction to a flow of fluid according to the fluid flow through the bypass flow path.

The bypass arrangement may be configured such that an actuation force generated using variable flow restriction is insufficient to overcome a bias which acts to retain the bypass arrangement in an open state for fluid flow rates less than a threshold flow rate, for example during emptying of fluid from an associated tubing string. The bypass arrangement may be configured such that an actuation force generated using variable flow restriction is sufficient to overcome the bias for flow rates greater than or equal to the threshold flow rate thereby reconfiguring the bypass arrangement in a closed state, for example during pressurization of fluid within an associated tubing string.

The bypass arrangement may comprise a variable flow restrictor. Such a flow restrictor may be configured to vary a restriction to fluid flow according to the fluid flow. The flow restrictor may be movable according to the flow. For example, the flow restrictor comprise a floating member that moves with the flow to vary the flow restriction.

The flow restrictor may be defined by a flow restrictor ring slidably mounted between a first extreme in which the flow restrictor ring co-operates with a first feature of the valve assembly such as a first lip, flange, shoulder, rim or the like of the valve assembly to define a first restriction, and a second extreme in which the flow restrictor ring co-operates with a second feature of the valve assembly such as a second lip, flange, shoulder, rim or the like of the valve assembly to define a second, greater restriction.

The flow restrictor ring may, for example, comprise a first set of one or more features such as one or more notches, recesses, castellations, apertures or the like which co-operate with the first feature of the valve assembly to define the first restriction.

The flow restrictor ring may comprise a second set of one or more features such as one or more notches, recesses, castellations, apertures or the like which co-operate with the second feature of the valve assembly to define the second restriction.

The first set of features of the flow restrictor ring may comprise more features than the second set of features of the flow restrictor ring.

The size of the features in the first set of features of the flow restrictor ring may be greater than the size of the features in the second set of features of the flow restrictor ring.

The flow restrictor may be configured to provide an applied force of a predetermined magnitude to the flow restrictor for a given pressure in an associated tubing string.

The valve assembly may comprise a valve sleeve assembly configured to selectively open and close communication between the housing flow path and bypass flow path.

For example, the bypass arrangement may comprise a valve sleeve assembly configured to selectively open and close communication between the housing flow path and bypass flow path.

The valve sleeve assembly may define a central flow path that constitutes part of the housing flow path.

The valve sleeve assembly may comprise a sleeve.

The sleeve may define a central flow path that constitutes part of the housing flow path.

The valve sleeve assembly may comprise the barrier member.

The valve sleeve assembly may be slidably mounted for displacement within the housing to selectively permit or prevent communication between the housing flow path and the bypass flow path.

The valve sleeve assembly may be moveable between a first position in which the bypass arrangement is in the open state and a second position in which the bypass arrangement is in the closed state.

The valve sleeve assembly may be biased towards a first position in which the bypass arrangement is in the open state. For example, the bypass arrangement may comprise a bias member such as a spring configured to bias the valve sleeve assembly towards the first position. The valve sleeve assembly may be moveable against the bias to a second position in which the bypass arrangement is in the closed state. For example, the valve sleeve assembly may be moveable to the second position under the action of an applied force that opposes the bias.

The valve sleeve assembly may comprise a flow restrictor as defined above. For example, the valve sleeve assembly may comprise a first feature such a first lip, flange, shoulder, rim or the like which, together with a flow restrictor, defines a first restriction, and a second feature such as a second lip, flange, shoulder, rim or the like which, together with the flow restrictor, defines a second, greater restriction.

The flow restrictor may be configured to apply a predetermined actuation force to the valve sleeve assembly so as to overcome the bias for a given flow rate, for example, for a given flow rate in the bypass flow path.

The valve assembly may comprise a sealing arrangement. The sealing arrangement may be mounted within the housing of the valve assembly.

The sealing arrangement may, for example, comprise one or more sealing members that act to form one or more seals between the housing and the valve sleeve assembly, for example, between an inner surface of the housing and an outer surface of the valve sleeve assembly.

The valve sleeve assembly may be slidably mounted within the sealing arrangement so that relative movement between the valve sleeve assembly and the sealing arrangement selectively opens and closes communication between the housing flow path and the bypass flow path.

The sealing arrangement may be configured to form one or more seals between the housing and the valve sleeve assembly on a first side of one or more bypass ports of the valve sleeve assembly to provide communication between the housing flow path and the bypass flow path when the valve sleeve assembly is in a first position to thereby configure the bypass arrangement in the open state.

The sealing arrangement may be configured to form one or more seals between the housing and the valve sleeve assembly on a second side of the one or more bypass ports opposite the first side of the one or more bypass ports to prevent communication between the housing flow path and the bypass flow path when the valve sleeve assembly is in a second position to thereby configure the bypass arrangement in the closed state.

Thus, movement of the valve sleeve assembly between a first position corresponding to an open state of the bypass arrangement and a second position corresponding to a closed state of the bypass arrangement may result in movement of the sealing arrangement across the bypass ports.

The bypass ports may be configured to direct any particulate matter contained in a wellbore fluid away from the sealing arrangement during filling of an associated tubing string with the wellbore fluid. Thus, damage or clogging of the sealing arrangement by any such particulate matter is likely to be reduced especially during movement of the sealing arrangement across the bypass ports for reconfiguration of the bypass arrangement between open and closed states.

The valve sleeve assembly may comprise a scraper arrangement configured to prevent fluid borne particulate matter from damaging or fouling operation of the bypass arrangement. Such a scraper arrangement may, in particular, be configured to prevent such particulate matter from impeding, restricting or preventing relative displacement between a valve sleeve assembly and an outer housing. Such a scraper arrangement may prevent such particulate matter from penetrating between the valve sleeve assembly and the outer housing.

The valve assembly may comprise a bias member to hold the barrier member in a normally-closed position.

The valve assembly may comprise one or more frangible elements such as shear pins that are configured to hold the barrier member in a normally-closed position.

The valve assembly may comprise an actuation member which is configured for opening the barrier member.

The actuation member may be configured for displacement within the housing relative to the barrier member.

An end surface of the actuation member may be configured so that displacement of the actuation member towards the barrier member initially results in only a portion of the end surface engaging the barrier member.

The barrier member may be configured to pivot about a hinge and the end surface of the actuation member may be configured such that displacement of the actuation member towards the barrier member results in a portion of the end surface of the actuation member engaging the barrier member at a position opposite a location of the hinge. Such an arrangement may avoid application of excessive forces to the hinge and prevent damage to the hinge.

In at least one embodiment, the end surface of the actuation member may be curved.

The actuation member may be configured to provide at least a portion of the housing flow path. For example, the actuation member may be tubular.

The valve assembly may be configured so as to hold the actuation member so as to prevent the actuation member from opening the barrier member.

The valve assembly may comprise a bias member that urges the actuation member away from the barrier member.

The valve assembly may comprise one or more frangible elements such as one or more shear pins that are configured to prevent the actuation member opening the barrier member.

The valve assembly may comprise an actuator configured to actuate the actuator member to open the barrier member. For example, the valve assembly may comprise an actuator such as an electric motor, solenoid or the like or a hydraulic actuator or a variable flow restriction actuator configured for actuating the actuator member to open the barrier member. The actuator may comprise an annular piston associated with the actuator member.

The valve assembly may comprise a rupturable element such as a burst disc that may be ruptured on exposure to a predetermined threshold pressure, for example in response to a pressure exerted from a wellbore region surrounding the rupturable element.

The valve assembly may be configured such that rupturing of the rupturable element permits pressurized fluid to act on the actuation member so as to open the barrier member. A force applied by the pressurized fluid may, for example, be sufficient to overcome a bias or sufficient to break one or more frangible elements such as one or more shear pins that prevent the actuation member from opening the barrier member.

According to a second aspect of the present invention there is provided a valve assembly configured to selectively permit filling and pressurization of a tubing string during deployment into a wellbore, comprising:

a housing defining a housing flow path;

a barrier member configurable between open and closed positions to selectively restrict access through the housing flow path; and a bypass arrangement configurable between open and closed states to selectively permit fluid to bypass the valve member, wherein the valve assembly is configurable between:

a first configuration in which the barrier member is closed and the bypass arrangement is in the open state to permit fluid to enter the tubing string via the bypass arrangement;

a second configuration in which the barrier member is closed and the bypass arrangement is in the closed state to prevent fluid communication and allow pressurization of fluid within the tubing string; and a third configuration in which the barrier member is open to permit access through the housing flow path of the valve assembly.

It should be understood that one or more of the optional features associated with the first aspect may apply either alone or in any combination in relation to the second aspect.

According to a third aspect of the present invention there is provided a valve sleeve assembly comprising:

a tubular housing defining a housing flow path for communicating with a tubing string;

a barrier member located in the housing and configurable between a normally-closed position in which the barrier member restricts access through the housing flow path, and an open position in which access is permitted through the housing flow path; and a flow restrictor configured to restrict a flow of fluid past the flow restrictor according to the flow of fluid.

It should be understood that one or more of the optional features associated with the first aspect may apply either alone or in any combination in relation to the third aspect.

According to a fourth aspect of the present invention there is provided a method of deploying a tubing string in a wellbore containing a fluid, comprising:

coupling the tubing string to a valve assembly, the valve assembly comprising:

a housing defining a housing flow path for communicating with the tubing string;

a barrier member located in the housing; and a bypass arrangement;

configuring the barrier member in a normally-closed position in which the barrier member restricts access through the housing flow path;

configuring the bypass arrangement in an open state in which the bypass arrangement defines a bypass flow path that communicates with the housing flow path on opposite sides of the barrier member;

moving the tubing string including the valve assembly downwardly within the wellbore causing fluid from the wellbore to bypass the barrier member via the bypass flow path to thereby fill the tubing string;

configuring the bypass arrangement in a closed state in which fluid is prevented from bypassing the barrier member; and pressurizing fluid contained within the tubing string.

The method may comprise configuring the barrier member in an open position to permit access through the housing flow path.

The method may comprise the step of depressurizing fluid contained within the tubing string between the step of pressurizing fluid within the tubing string and the step of configuring the barrier member in an open position to permit access through the housing flow path.

The method may comprise:

moving the tubing string including the valve assembly upwardly within the wellbore when the barrier member is in the closed position but the bypass flow path is in the open state causing fluid from the wellbore to bypass the barrier member via the bypass flow path and thereby empty from the tubing string.

The method may comprise:

moving the tubing string including the valve assembly upwardly within the wellbore when the barrier member is in the open position causing fluid from the wellbore to flow along the housing flow path and thereby empty from the tubing string.

BRIEF DESCRIPTION OF THE FIGURES

The present invention will now be described by way of non-limiting example only with reference to the following figures of which.

DETAILED DESCRIPTION OF THE FIGURES

Figure 1A:
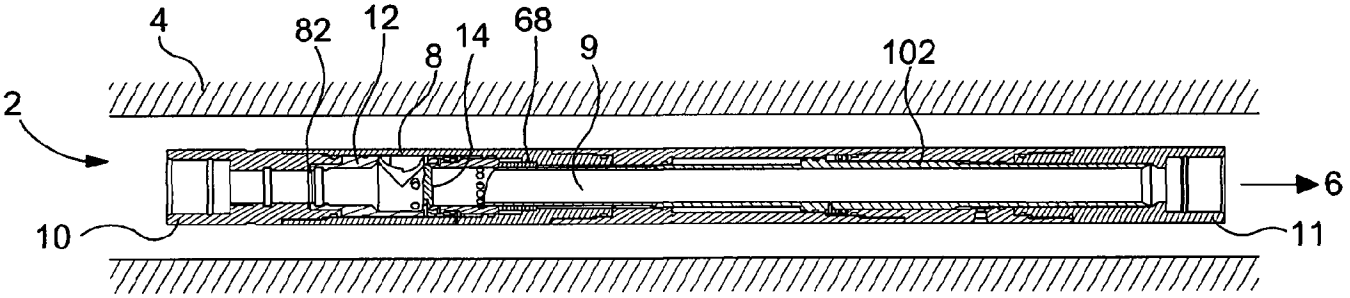
FIG. 1A is a cross-section of a valve assembly constituting an embodiment of the present invention and configured to permit filling of an associated tubing string with a wellbore fluid during deployment into a wellbore.
Figure 1B:
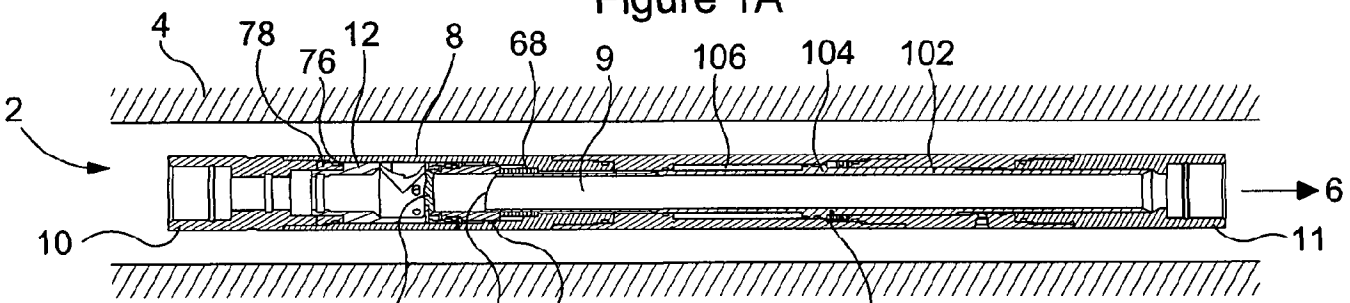
FIG. 1B is a cross-section of the valve assembly of FIG. 1A configured to permit pressurization of an associated tubing string for the integrity testing thereof during deployment into the wellbore.
Figure 1C:
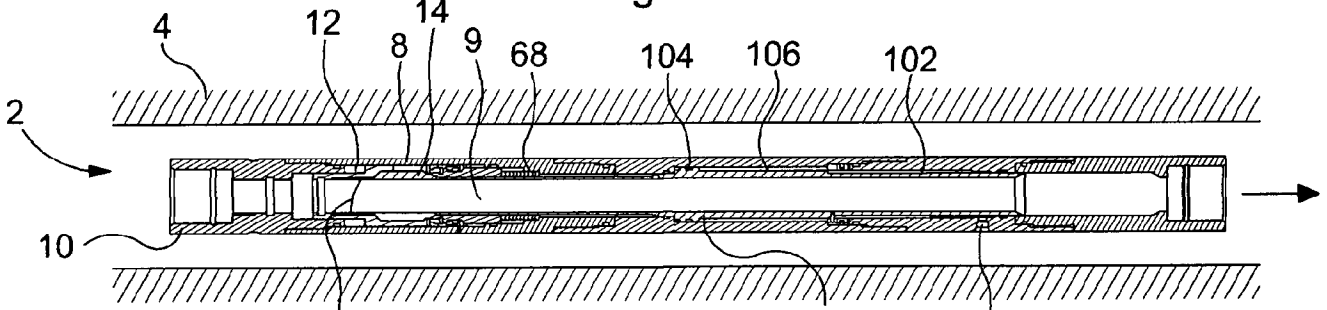
FIG. 1C is a cross-section of the valve assembly of FIG. 1A configured for use of an associated tubing string after deployment into the wellbore.

Referring initially to FIG. 1A there is shown a generally tubular valve assembly generally designated 2 located in a wellbore 4 during deployment of a tubing string (not shown) into the wellbore 4. In FIG. 1A the downhole direction is indicated by arrow 6. It should be understood that references to a particular direction or orientation such as "down", "up", "upper", "lower", "above", "below", "side" and the like used throughout the following description apply to the orientation of the valve assembly 2 in use downhole as shown in FIGS. 1A-1C and are not intended to be limiting in any way. For example, the valve assembly 2 may be utilised in vertical, deviated and/or horizontal wellbores.

The valve assembly 2 comprises a generally tubular housing 8 defining a housing flow path 9. In the embodiment shown the housing 8 comprises an upper threaded end portion 10 for coupling to a lower threaded end portion of a tubing string (not shown) and a lower threaded end portion 11 for coupling to an upper end portion of a further tubing string (not shown), or a further component, such as a tubing shoe or the like.

The valve assembly 2 comprises a generally tubular valve sleeve assembly 12 located within the housing 8. As described in more detail below, the valve sleeve assembly 12 further comprises a barrier member 14 that is configurable between a normally-closed position shown in FIGS. 1A and 1B in which the barrier member 14 prevents fluid flow along the housing flow path 9 and an open position shown in FIG. 1C in which fluid flow is permitted along the housing flow path 9.

Figure 2A:
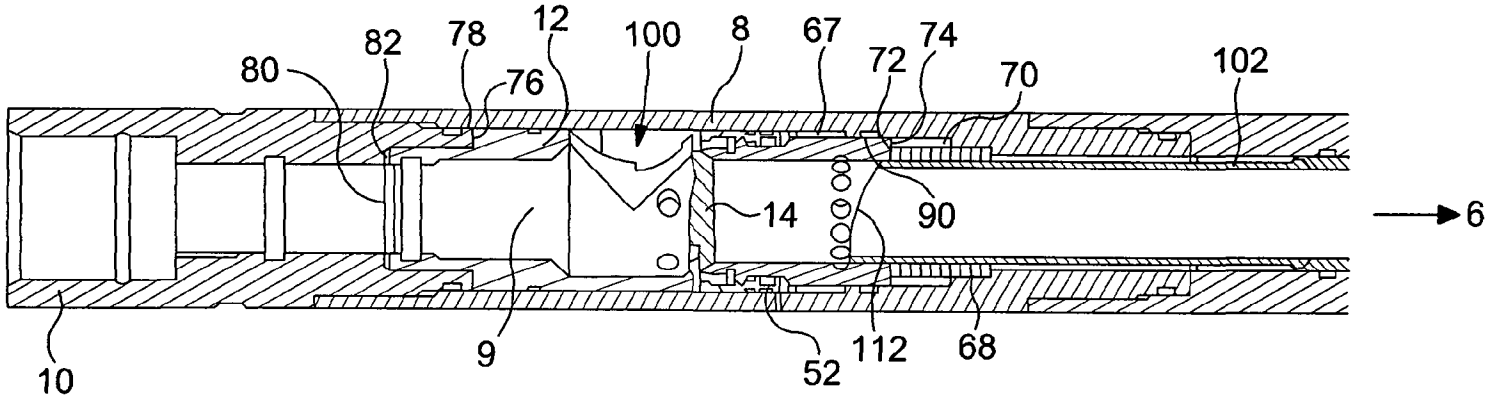
FIG. 2A is an enlarged cross-section of an upper portion of the valve assembly of FIG. 1A.
Figure 2B:
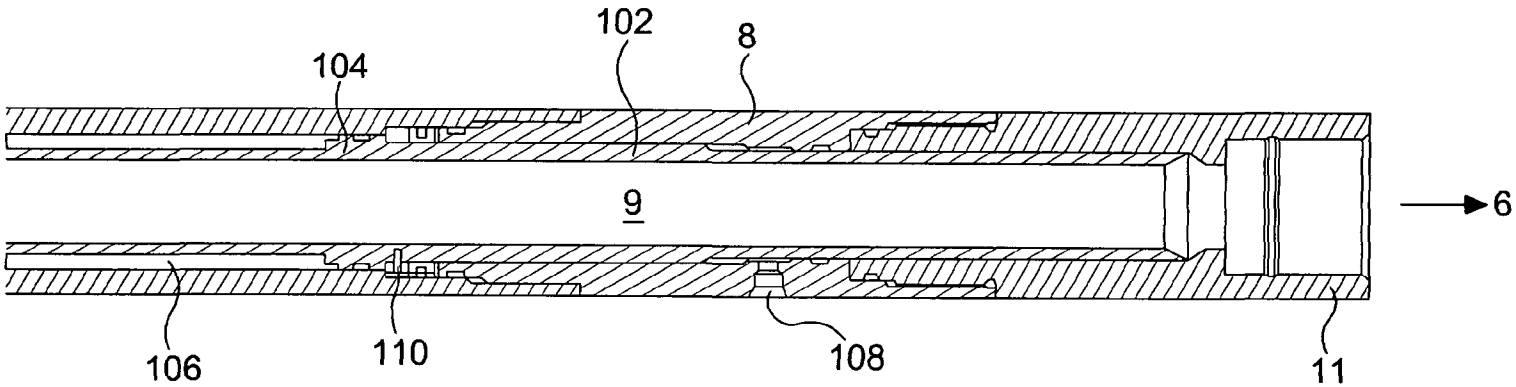
FIG. 2B is an enlarged cross-section of a lower portion of the valve assembly of FIG. 1A.

As shown in more detail in FIG. 2A, the valve sleeve assembly 12 is configured for displacement within the housing 8. The valve sleeve assembly 12 is biased towards an upper position shown in FIGS. 1A and 2A within the housing 8 so as to permit filling of the tubing string with fluid from the wellbore 4. The valve sleeve assembly 12 is movable towards a lower position shown in FIG. 1B within the housing 8 against the bias so as to permit pressurization of fluid within the tubing string for the integrity testing thereof. Once integrity testing has been completed, fluid within the tubing string may be depressurized and the barrier member 14 may be opened to permit fluid flow along the housing flow path 9, for example to permit a fluid to flow along the housing flow path 9 to surface.

Figure 3A:
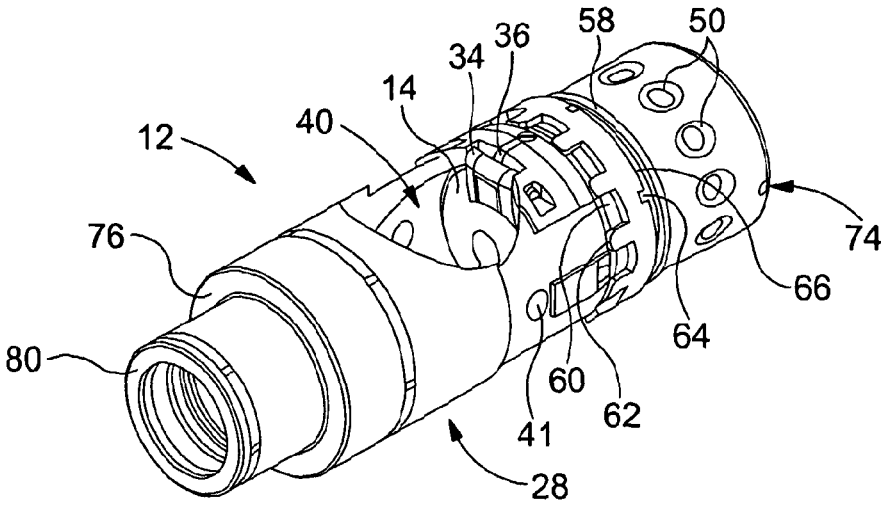
FIG. 3A is a perspective view of a valve sleeve assembly of the valve assembly of FIG. 1A.
Figure 3B:
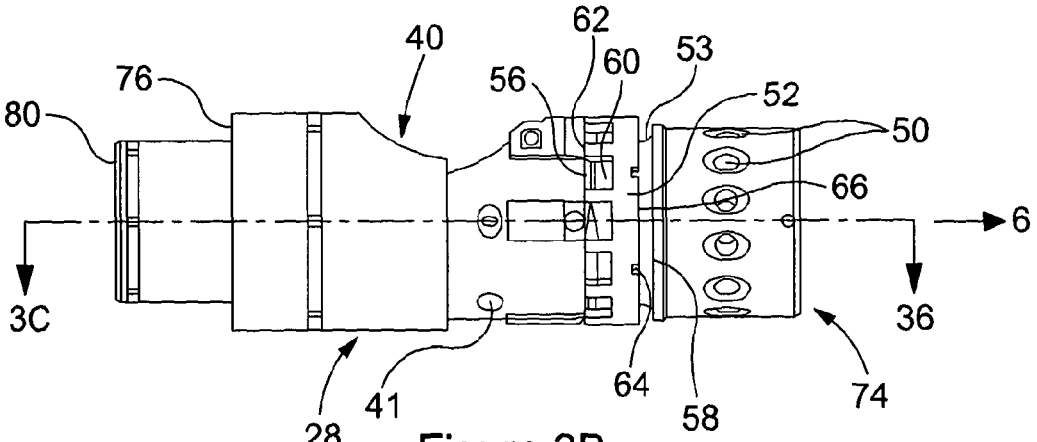
FIG. 3B is a side view of the valve sleeve assembly of FIG. 3A.
Figure 3C:
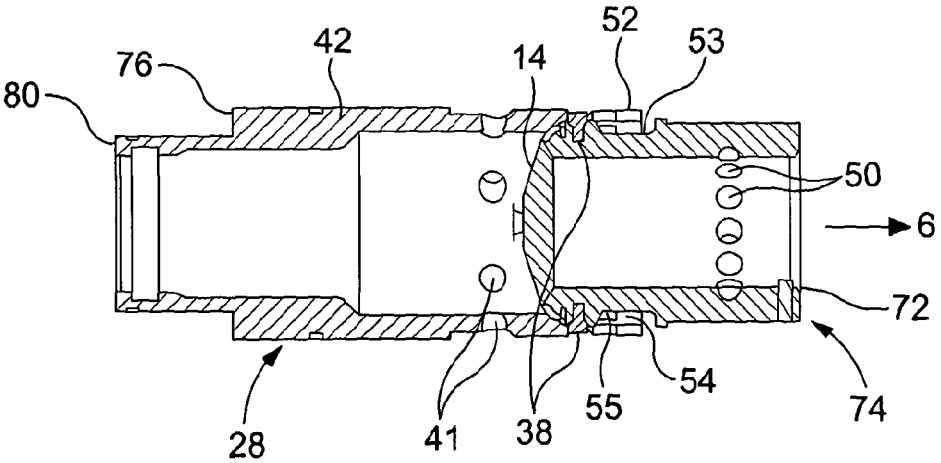
FIG. 3C is a cross-section of the valve sleeve assembly of FIG. 3A taken through line 3C-3C in FIG. 3B.

With reference to FIGS. 3A to 3C, the valve sleeve assembly 12 comprises the barrier member 14 and a generally tubular sleeve 28 located within the housing flow path 9. The barrier member 14 is pivotally connected to the sleeve 28 by a hinge 34. The valve sleeve assembly 12 comprises a spring 36 which is configured around the hinge 34 to bias the barrier member 14 in the closed position shown in FIGS. 3A to 3C. As shown most clearly in FIG. 2A, the barrier member 14 is also held in the normally-closed position by a shear pin 38. The valve sleeve assembly 12 comprises a larger side aperture 40 and a plurality of smaller side apertures 41 formed in a side wall 42 of the sleeve 28 at a position above the barrier member 32. The larger side aperture 40 is configured to accommodate the barrier member 14 when the barrier member 14 is configured in the open position as shown in FIG. 1C. Both the larger side aperture 40 and smaller side apertures 41 form upper bypass ports.

The valve sleeve assembly 12 further comprises a plurality of lower bypass ports 50 formed through the side wall 42 of the sleeve 28 at a position below the barrier member 14. The bypass ports 50 are arranged around an axis of the valve sleeve assembly 12 with a uniform angular distribution.

The valve sleeve assembly 12 comprises a flow restrictor ring 52 located around an intermediate portion 53 of the valve sleeve assembly 12 located axially between the lower bypass ports 50 and upper bypass ports formed by the larger side aperture 40 and smaller apertures 41. The valve sleeve assembly 12 is configured to provide a gap 54 between an inner surface of the flow restrictor ring 52 and an outer surface of the neck portion 53. More specifically, valve sleeve assembly 12 comprises a resilient centralising arrangement 55 which biases the flow restrictor ring 52 towards a coaxial alignment with the valve sleeve assembly 12.

The intermediate portion 53 of the valve sleeve assembly 12 is defined between upper and lower shoulders 56 and 58 respectively formed on an outer surface of the sleeve 28. The flow restrictor ring 52 comprises a series of larger notches 60 formed around an upper edge 62 thereof and a series of smaller notches 64 formed around a lower edge 66 thereof.

The flow restrictor ring 52 and the intermediate portion 53 are configured to permit axial displacement of the flow restrictor ring 52 between a first position shown in FIGS. 3A to 3C in which the upper edge 62 of the flow restrictor ring 52 engages the upper shoulder 56 of the side wall 42 and a second position (not shown) in which the lower edge 66 of the flow restrictor ring 52 engages the lower shoulder 56 of the side wall 42 according to a flow of fluid around the flow restrictor ring 52.

As shown most clearly in FIG. 2A, the flow restrictor ring 52 and the housing 8 are configured such that an outer surface of the flow restrictor ring 52 engages an inner surface of the housing 8 when the valve sleeve assembly 12 is located within the housing 8. The housing 8 and the valve sleeve assembly 12 together define a generally annular recess 67 between an inner surface of the housing 8 and an outer surface of the valve sleeve assembly 12. The housing 8 and the valve sleeve assembly 12 are configured to provide a sliding fit for the flow restrictor ring 52 within the recess 67.

As shown most clearly in FIGS. 1A and 2A, the valve assembly 2 comprises a bias spring 68 that acts between a recess 70 of the housing 8 and a recess 72 formed in a lower end 74 of the valve sleeve assembly 12 to bias the valve sleeve assembly 12 towards an upper position within the housing 8 such that a shoulder 76 of the valve sleeve assembly 12 engages a recess 78 of the housing 8. An upper end face 80 of the valve sleeve assembly 12 carries a sealing arrangement comprising a metal to metal seal and a rubber flapper seal for sealing with a further recess 82 of the housing 8.

In addition, the valve assembly 2 comprises a sealing arrangement 90 mounted within the housing 8 and configured to form a seal between an inner surface of the housing 8 and an outer surface of the valve sleeve assembly 12.

The housing 8 and the valve sleeve assembly 12 together define a bypass flow path generally designated 100 which communicates with the housing flow path 9 so as to bypass the barrier member 14 and the sealing arrangement 90 via the lower bypass ports 50 of the valve sleeve assembly 12, the annular recess 67 and the upper bypass ports defined by the larger and smaller side apertures 40, 41 of the valve sleeve assembly 12. The gap 54 defined between the flow restrictor ring 52 and the valve sleeve assembly 12 also defines a portion of the bypass flow path 100.

During deployment, the valve assembly 2 is run into the wellbore 4 as part of a tubing string (not shown) in the initial configuration shown in FIGS. 1A (and 2A and 2B) with the valve sleeve assembly 12 located at its uppermost position and the sealing arrangement 90 forming a seal around the sleeve 28 of the valve sleeve assembly 12 at a position located downwardly of the lower bypass ports 50. The valve assembly 2 moves downwardly through the wellbore fluid such that fluid enters the valve assembly 2 through a lower end thereof and flows through the bypass flow path 100 to fill the tubing string (not shown) located above the valve assembly 2.

During deployment of the valve assembly 2 and associated tubing string (not shown) into the wellbore 4, the flow restrictor ring 52 will be engaged against the upper shoulder 56 of the valve sleeve 12, thus causing the larger notches 60 to present a minimal restriction to flow.

In the present embodiment the lower bypass ports 50 are angled to establish rotational flow and a degree of turbulence within the bypass flow path 11 which may assist to prevent blockage from particulate material transported in the fluid.

It may be desirable to test the integrity of the tubing string associated with the valve assembly 2 during deployment into the wellbore 4, for example to test the integrity of tubing connectors, such as threaded connectors. To facilitate this deployment may be arrested and the fluid within the tubing string located above the valve sleeve assembly 12 pressurized, for example via surface pumps. This results in a downward flow of fluid through the bypass flow path 100 causing the flow restrictor ring 52 to be displaced downwardly until the lower edge 66 of the flow restrictor ring 52 engages the lower shoulder 58 of the sleeve 28 and fluid flow becomes subject to the increased restriction imposed by the smaller notches 64. The restriction to flow imposed by the notches 64 generates a back pressure which acts to displace the valve sleeve assembly 12 downwardly against the bias of the spring 68 until the bypass ports 50 move below the sealing arrangement 90 which then prevents further fluid flow along the bypass flow path 100. With both the bypass flow path 100 and the housing flow path 9 closed, further pressurization of the tubing string (not shown) located above the valve assembly 2 is possible for the integrity testing thereof.

Once pressure integrity testing is completed, the pressure within the tubing string may be relieved and deployment continued, and the process of deployment and pressurisation/testing repeated as desired.

Once the required depth is reached the barrier member 14 may be opened to permit full bore access via the housing flow path 9. As shown in FIGS. 1A-1C and FIG. 2B, the valve assembly 2 further comprises a generally tubular actuation sleeve 102 slidably mounted within the housing 8. The actuation sleeve 102 comprises an annular piston member 104 which extends into an annular recess 106 defined between an outer surface of the actuation sleeve 102 and an inner surface of the housing 8. The valve assembly 2 further comprises a burst disc arrangement 108 which is in communication with the recess 106 and one or more shear pins 110 which are configured to hold the actuation sleeve 102 in its lowermost position shown in FIG. 1B and FIG. 2B with the annular piston member 104 located at a lower end of the recess 106 until it is desired to open the barrier member 14.

To open the barrier member 14, the pressure of fluid in the wellbore 4 is raised to rupture the burst disc 108 to permit pressurised wellbore fluid to flow into the recess 106 and act upon the annular piston member 104 thereby urging the actuation sleeve 102 upwardly towards its uppermost position shown in FIG. 1C, engaging the barrier member causing the shear pin 38 to shear and permit the barrier member to be pivoted open. In this position, the actuation sleeve 102 provides substantially full bore access for fluid and/or equipment through the housing flow path. The actuation sleeve 102 has a curved upper end 112 which is configured to first engage the barrier member 14 at a position or at positions opposite the hinge 34 thereby avoiding the application of excessive forces and avoiding damage to the hinge 34.

One skilled in the art will appreciate that various modifications may be made to the foregoing embodiment of the valve assembly 2 without departing from the scope of the present invention. For example, rather than using flow restriction to actuate the valve sleeve assembly 12 within the housing 8 between its uppermost and its lowermost positions and thereby control the state of the bypass flow path 100, the valve assembly may comprise any suitable means for actuation of the valve sleeve assembly 12. For example, the valve assembly 2 may comprise an electric actuator such as a motor, solenoid, or the like or a hydraulic actuator configured for actuating the valve sleeve assembly 12. Similarly, the valve assembly 2 may comprise any suitable means for actuation of the actuation sleeve 102, for example an electric actuator such as a motor, solenoid, or the like or a variable flow restrictor.

The invention claimed is:

1. A valve assembly configured to be coupled to a tubing string, comprising:

a housing defining a housing flow path for communicating with the tubing string;

a barrier member located in the housing and configurable between a normally-closed position in which the barrier member restricts access through the housing flow path, and an open position in which access is permitted through the housing flow path; and a bypass arrangement reconfigurable between an open state in which the bypass arrangement defines a bypass flow path that communicates with the housing flow path on opposite sides of the barrier member to permit fluid to bypass the barrier member and thereby fill the tubing string, and a closed state in which fluid is prevented from bypassing the barrier member to thereby permit pressurization of the tubing string, wherein the bypass arrangement comprises a variable flow restrictor; and wherein the flow restrictor is defined by a flow restrictor ring slidably mounted between a first position in which the flow restrictor ring co-operates with a first feature of the valve assembly to define a first restriction, and a second position in which the flow restrictor ring co-operates with a second feature of the valve assembly to define a second, greater restriction.

2. The valve assembly according to claim 1, wherein the bypass arrangement is biased towards an open state to be configurable between a normally-open state and the closed state against said bias.

3. The valve assembly according to claim 1, wherein the housing flow path is located radially inwardly of the bypass flow path.

4. The valve assembly according to claim 1, wherein the housing flow path is located within the bypass flow path.

5. The valve assembly according to claim 1, wherein the housing flow path is located substantially centrally within the housing and generally aligned along an axis thereof.

6. The valve assembly according to claim 1, wherein at least a portion of the bypass flow path is defined within the housing.

7. The valve assembly according to claim 1, wherein the bypass arrangement defines an annular bypass flow path which circumferentially surrounds at least a portion of the housing flow path.

8. The valve assembly according to claim 1, wherein the bypass arrangement comprises one or more bypass ports on opposite sides of the barrier member configured to facilitate communication between the bypass flow path and the housing flow path.

9. The valve assembly according to claim 8, wherein at least one bypass port is configured to impart rotational flow within the bypass flow path.

10. The valve assembly according to claim 1, wherein the bypass arrangement is configured to permit flow through the bypass flow path in opposite directions.

11. The valve assembly according to claim 10, wherein the bypass arrangement is reconfigurable to an open state in response to flow in one direction, and be reconfigurable into a closed state in response to flow in an opposite direction.

12. The valve assembly according to claim 1, wherein the bypass arrangement is configured for actuation using variable flow restriction.

13. The valve assembly according to claim 1, wherein the flow restrictor ring is moveable between the first and second positions in response to the direction of fluid flow through the bypass arrangement.

14. The valve assembly according to claim 1, comprising a valve sleeve assembly comprising a sleeve, wherein the valve sleeve assembly is configured to selectively open and close communication between the housing flow path and bypass flow path.

15. The valve assembly according to claim 14, wherein the valve sleeve assembly defines a central flow path that constitutes part of the housing flow path.

16. The valve assembly according to claim 14, wherein the valve sleeve assembly comprises the barrier member.

17. The valve assembly according to claim 14, wherein the valve sleeve assembly is slidably mounted for displacement within the housing to selectively permit or prevent communication between the housing flow path and the bypass flow path.

18. The valve assembly according to claim 14, wherein the valve sleeve assembly is biased towards a first position in which the bypass arrangement is in the open state, and the valve sleeve assembly is moveable against the bias to a second position in which the bypass arrangement is in the closed state.

19. The valve assembly according to claim 14, wherein the valve sleeve assembly comprises a flow restrictor configured to apply an actuation force to the valve sleeve assembly in accordance with a fluid flow condition to reconfigure the valve sleeve assembly to selectively open and close communication between the housing flow path and bypass flow path.

20. The valve assembly according to claim 14, wherein the valve assembly comprises a sealing arrangement configured to form one or more seals between the housing and the valve sleeve assembly.

21. The valve assembly according to claim 20, wherein the valve sleeve assembly is slidably mounted within the sealing arrangement so that relative movement between the valve sleeve assembly and the sealing arrangement selectively opens and closes communication between the housing flow path and the bypass flow path.

22. The valve assembly according to claim 1, comprising a bias member to hold the barrier member in a normally-closed position.

23. The valve assembly according to claim 1 comprising one or more frangible elements configured to hold the barrier member in a normally-closed position.

24. The valve assembly according to claim 1, comprising an actuation member configured for opening the barrier member.

25. The valve assembly according to claim 24, wherein the actuation member is configured for displacement within the housing relative to the barrier member.

26. The valve assembly according to claim 24, wherein the barrier member is configured to pivot about a hinge and an end surface of the actuation member is configured such that displacement of the actuation member towards the barrier member results in a portion of the end surface of the actuation member engaging the barrier member at a position opposite a location of the hinge.

27. The valve assembly according to claim 24, wherein an end surface of the actuation member for engaging the barrier member is curved.

28. The valve assembly according to claim 24, wherein the actuation member is configured to form at least a portion of the housing flow path.

29. The valve assembly according to claim 24, comprising an actuator configured to actuate the actuator member to open the barrier member.

30. The valve assembly according to claim 24, wherein the actuator member is hydraulically operated.

31. The valve assembly according to claim 30, wherein the actuator is hydraulically operated by exposure to wellbore pressure.

32. A method for deploying a tubing string in a wellbore containing a fluid, comprising:

coupling the tubing string to a valve assembly, the valve assembly comprising:

a housing defining a housing flow path for communicating with the tubing string;

a barrier member located in the housing; and a bypass arrangement;

configuring the barrier member in a normally-closed position in which the barrier member restricts access through the housing flow path;

configuring the bypass arrangement in an open state in which the bypass arrangement defines a bypass flow path that communicates with the housing flow path on opposite sides of the barrier member, wherein the bypass arrangement comprises a variable flow restrictor defined by a flow restrictor ring slidably mounted between a first position in which the flow restrictor ring co-operates with a first feature of the valve assembly to define a first restriction, and a second position in which the flow restrictor ring co-operates with a second feature of the valve assembly to define a second, greater restriction;

moving the tubing string including the valve assembly downwardly within the wellbore causing fluid from the wellbore to bypass the barrier member via the bypass flow path to thereby fill the tubing string;

configuring the bypass arrangement in a closed state in which fluid is prevented from bypassing the barrier member; and pressurizing fluid contained within the tubing string.

33. The method according to claim 32, comprising configuring the barrier member in an open position to permit access through the housing flow path.

34. The method according to claim 33, comprising depressurizing fluid contained within the tubing string between the step of pressurizing fluid within the tubing string and the step of configuring the barrier member in an open position to permit access through the housing flow path.

35. A valve assembly for selectively permitting filling and pressurization of a tubing string during deployment into a wellbore, comprising:

a housing defining a housing flow path;

a barrier member configurable between open and normally-closed positions to selectively restrict access through the housing flow path; and a bypass arrangement configurable between open and closed states to selectively permit fluid to bypass the valve member, the bypass arrangement comprising a variable flow restrictor defined by a flow restrictor ring slidably mounted between a first position in which the flow restrictor ring co-operates with a first feature of the valve assembly to define a first restriction, and a second position in which the flow restrictor ring co-operates with a second feature of the valve assembly to define a second, greater restriction, wherein the valve assembly is configurable between:

a first configuration in which the barrier member is in the normally-closed position and the bypass arrangement is in the open state to permit fluid to enter the tubing string via the bypass arrangement;

a second configuration in which the barrier member is in the normally-closed position and the bypass arrangement is in the closed state to prevent fluid communication and allow pressurization of fluid within the tubing string; and a third configuration in which the barrier member is open to permit access through the housing flow path of the valve assembly.

* * * * *